US007300115B2

(12) United States Patent
Holl et al.

(10) Patent No.: US 7,300,115 B2
(45) Date of Patent: Nov. 27, 2007

(54) CHISEL HOLDER

(75) Inventors: Bernd Holl, Neustadt/Wied (DE); Günter Tewes, Unkel/Rhein (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 11/274,947

(22) Filed: Nov. 15, 2005

(65) Prior Publication Data

US 2006/0119165 A1 Jun. 8, 2006

(30) Foreign Application Priority Data

Nov. 26, 2004 (DE) ..... 10 2004 057 302

(51) Int. Cl.
*E21C 35/18* (2006.01)

(52) U.S. Cl. ..... 299/106

(58) Field of Classification Search ..... 299/100–113
See application file for complete search history.

(56) References Cited

U.S. PATENT DOCUMENTS

| | | | | |
|---|---|---|---|---|
| 4,818,027 A | | 4/1989 | Simon | |
| 5,125,720 A | * | 6/1992 | Salani | 299/107 |
| 5,378,050 A | * | 1/1995 | Kammerer et al. | 299/102 |
| 5,683,144 A | | 11/1997 | Kammerer et al. | |
| 6,183,170 B1 | * | 2/2001 | Wald et al. | 407/46 |
| 6,619,757 B1 | | 9/2003 | Kammerer | |

FOREIGN PATENT DOCUMENTS

| | | | |
|---|---|---|---|
| DE | 37 01 905 C1 | | 9/1988 |
| DE | 43 22 401 C2 | | 6/1996 |
| DE | 199 02 766 A1 | | 8/2000 |
| DE | 102005001536 B3 | * | 1/2006 |
| DE | 102004053665 A1 | * | 5/2006 |
| WO | WO 2005100748 A1 | * | 10/2005 |
| WO | WO 2006000270 A1 | * | 1/2006 |

* cited by examiner

*Primary Examiner*—Sunil Singh
(74) *Attorney, Agent, or Firm*—Pauley Petersen & Erickson

(57) ABSTRACT

A chisel holder for a road milling machine or the like, having a base element which supports a holding neck, wherein the holding neck has a chisel receiver and a protrusion is connected to the base element upstream of the holding neck when viewed in an advancing direction of the tool. For improving the cutting output, in particular in connection with rough-chipped milling materials, the base element has a connecting section designed as a chip breaker, which is formed on the base element and extends, starting at the holding neck, at least partially over the protrusion.

16 Claims, 3 Drawing Sheets

CHISEL HOLDER

BACKGROUND OF THE INVENTION

1. Field of the Invention

This invention relates to a chisel holder for a road milling machine or the like, having a base element which supports a holding neck, wherein the holding neck has a chisel receiver and a protrusion is connected to the base element upstream of the holding neck when viewed in an advancing direction of the tool.

2. Discussion of Related Art

A chisel holder is known from German Patent Reference DE 43 22 401 C2 (U.S. Pat. No. 5,683,144). The known chisel holder has a plug-in neck, by which it is exchangeably held in a plug-in receiver of a base body. The base body is fastened on an outer circumference of a milling roller tube. The plug-in neck of the chisel holder is connected in one piece to a base element. On a side facing away from the plug-in neck, the base element has a holding neck. The holding neck has a bore into which a shank chisel can be inserted in a known manner. By way of example, German Patent Reference DE 37 01 905 C1 (U.S. Pat. No. 4,818,027) shows a possible assembly situation.

The holding neck of the chisel holder has a cylindrical section, into which wear markers designed as encircling groove-like depressions are cut. In the area upstream of the holding neck, when viewed in the advancing direction of the tool, the base element has a protrusion designed in a form of an apron, which covers a surface of the base body into which the plug-in receiver for the plug-in neck is cut. This area of the base body is thus protected. Chisel holders are also known in the prior art which are directly fastened on the milling roller tube without a base body.

The above described chisel holders are employed in road milling machines, but also in species-related earth processing machinery, such as soil stabilizers, mining machinery, etc. The power consumption of the machine changes as a function of the nature of the ground to be worked. It is known that coverings built up in layers which, when cut, tend to form clod-like chips, and offer a high resistance to the tool. Such chip shapes are generated, for example, when cutting asphalt surfaces in which an insufficient holding bond exists between the cover layer, mostly approximately 4 cm thick, and the binder layer.

SUMMARY OF THE INVENTION

It is one object of this invention to provide a chisel holder of the type mentioned above but in which the cutting output of a road milling cutter or the like can be improved.

This object is achieved if the base element has a connecting section designed as a chip breaker, which is formed on the base element and extends, starting at the holding neck, at least partially over the protrusion.

It is possible with the chip breaker to effectively cut up the created chips, in particular larger clods. The cutting resistance which the chisel holder offers the milled material is thus reduced, which results in a reduction of the power consumption.

An improvement of the machine efficiency can thus be obtained.

A connection of the holding neck with the protrusion by the connecting section results in an improved tool stiffness. This has a positive effect, in particular in connection with exposed holding necks and/or protrusions, and leads to an increase in the tool life.

In accordance with one embodiment of this invention, the connecting section extends in the tool advancement direction. A cutting geometry is thus created which offers a low penetration resistance to the milled material.

In one embodiment of this invention, the connecting section forms a strip section, the holding neck has an end section protruding beyond or past the base element, and the strip width extending transversely with respect to the advancement direction is less than the dimension of the end section in this direction.

In a further embodiment of this invention, the end section of the holding neck has a chisel receiver embodied as a bore. The end section has a support surface encircling a center longitudinal axis of the chisel receiver in an annular manner. The support surface extends radially outward as far as the dimensional limits of a cylindrical area of the end section. The connecting section is connected, set back in the axial direction with respect to the support surface, with the holding neck. The cylindrical area of the holding neck forms a wear zone such as described in German Patent Reference DE 199 02 766.8-24 (U.S. Pat. No. 6,619,757), the entire disclosure of which is incorporated into this Specification by reference.

The head of the shank chisel is supported on the annular support surface with a wear-protection disk placed between them. The wear-protection disk extends at least as far as the dimensional limits of the support surface. A wear system is thus created. When using the tool, the wear-protection disk rotates on the support surface and continuously wears the cylindrical area off. The holding neck is stabilized by the set-back arrangement of the connecting section, but this wear system is not impaired.

In order to assure a continuous chip deflection with this invention, the connecting section has chip guidance faces on both sides of the strip section which, starting at the strip section, diverge in the direction toward the base element. The connecting section is connected to the holding neck via groove-shaped transition sections.

An optimization of the cutting geometry of the chisel holders results if the base element is laterally delimited by two inclined faces in the area of or near the protrusion, which are arranged in an arrow shape with respect to each other in the tool advancement direction. The connecting section and the inclined faces terminate in a frontal end section of the protrusion. The frontal end section forms a tapered section which makes possible a good chip removal, in particular in connection with rough-chipped milling bases.

The service life of the chip holder can be optimized if the connecting section is hardened and/or if at least a mechanically resistant element is applied to the connecting section. A hard alloy, for example, can be used as the mechanically resistant element.

A good chip-breaking geometry results if the connecting section has a conical or rounded cutter shape.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
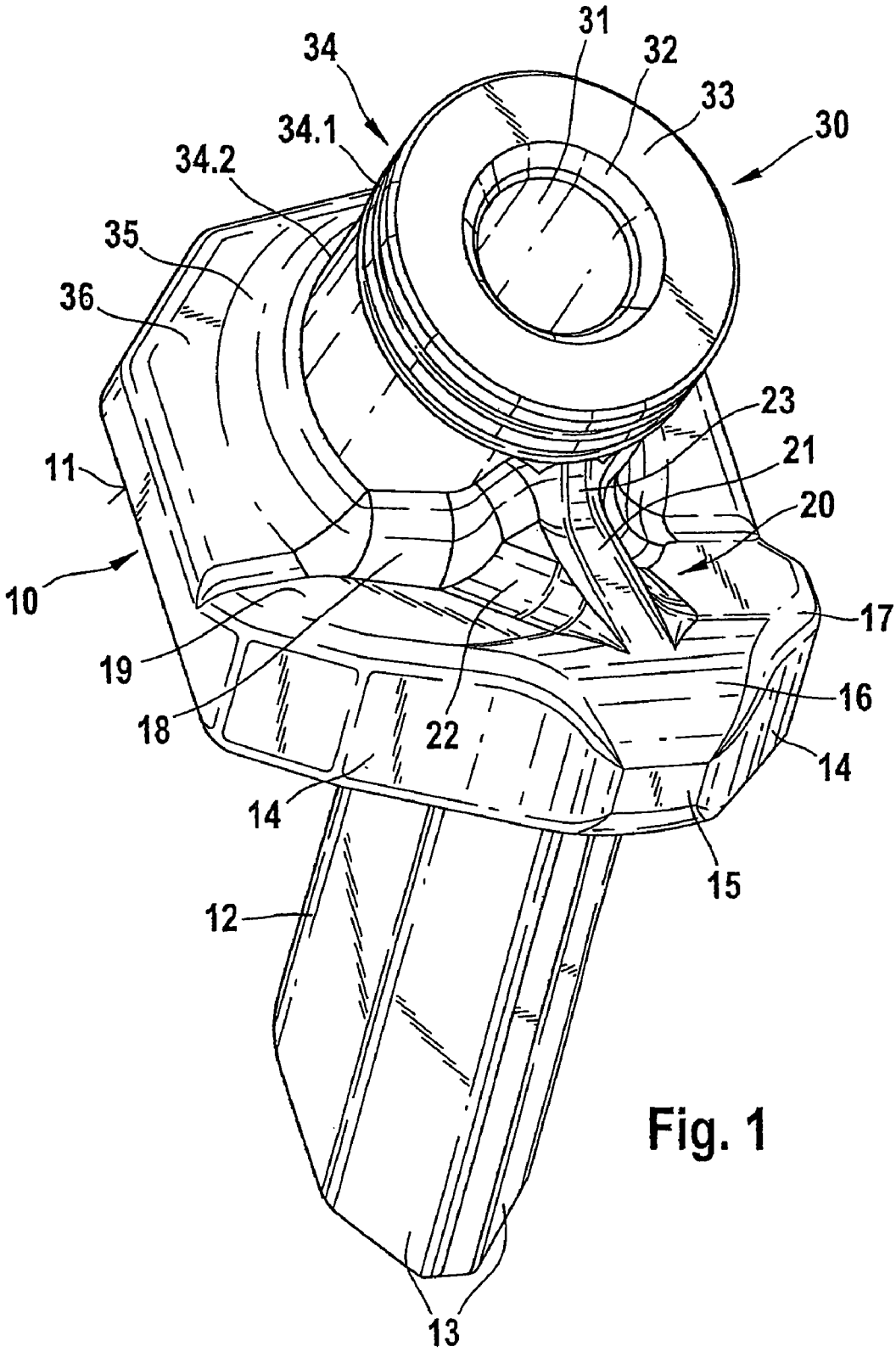
FIG. 1 shows a chisel holder in a perspective front view.

FIG. 1 shows a chisel holder with a base element 10. The base element 10 has a support section with a downward-oriented support surface 11. In an advancement direction the support element makes a transition into a protrusion 15. In this case, the protrusion 15 is arranged at an angle with respect to the support element.

A downward protruding plug-in neck 12 is formed on the base element 10 in the transition area from the support element to the protrusion 15. The chisel holder can be inserted by the plug-in neck 12 into a plug-in receiver of a base body 50. Then the plug-in neck 12 can be fixed in place in the plug-in receiver by clamping.

Figure 2:
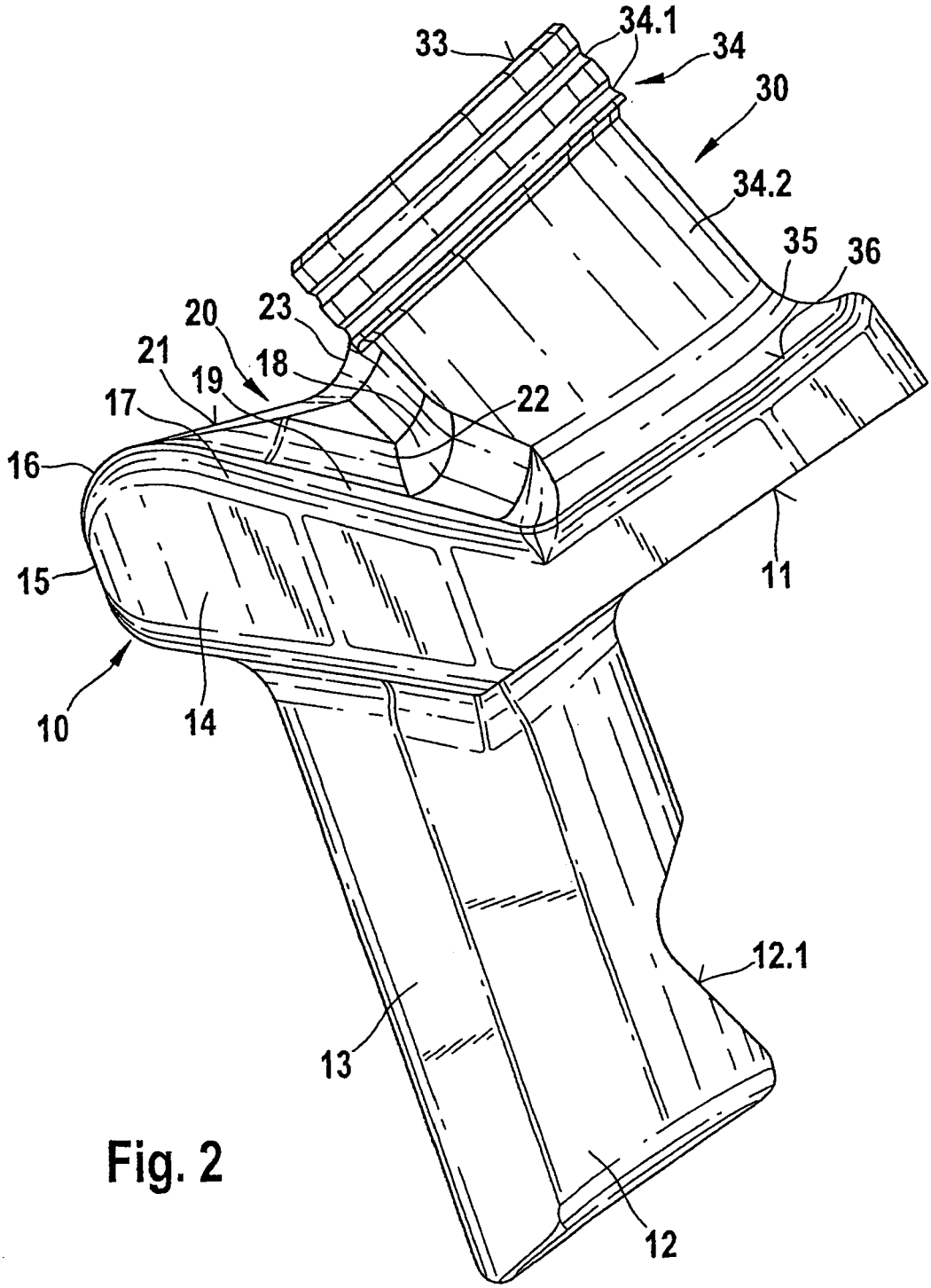
FIG. 2 shows the chisel holder in accordance with FIG. 1, in a lateral view.

Here, centering faces 13 at the front, as well as a rear clamping face 12.1 of the plug-in neck 12, shown in FIG. 2, are used as a support. In the assembled state, the chisel holder is supported by its support surface 11 on an opposite surface of the base body 50. The protrusion 15 covers a shoulder 51 of the base body 50 and thus protects it against the wearing action of the cut milled material. A holding neck 30 is formed by a connecting section 35 on the base element 10 of the chisel holder. The connecting section 35 can also have a geometry in the shape of a truncated cone or a groove. On its end facing away from the connecting section 35, the holding neck 30 terminates in a protruding cylindrical end section 34. Two wear markers 34.1 are turned into the end section 34 and extend concentrically around a bore, a chisel receiver 31, cut into the holding neck 30. Thus, the wear markers 34.1 form groove-shaped depressions, which are arranged behind a support surface 33 which closes off the cylindrical end section 34.

Figure 3:
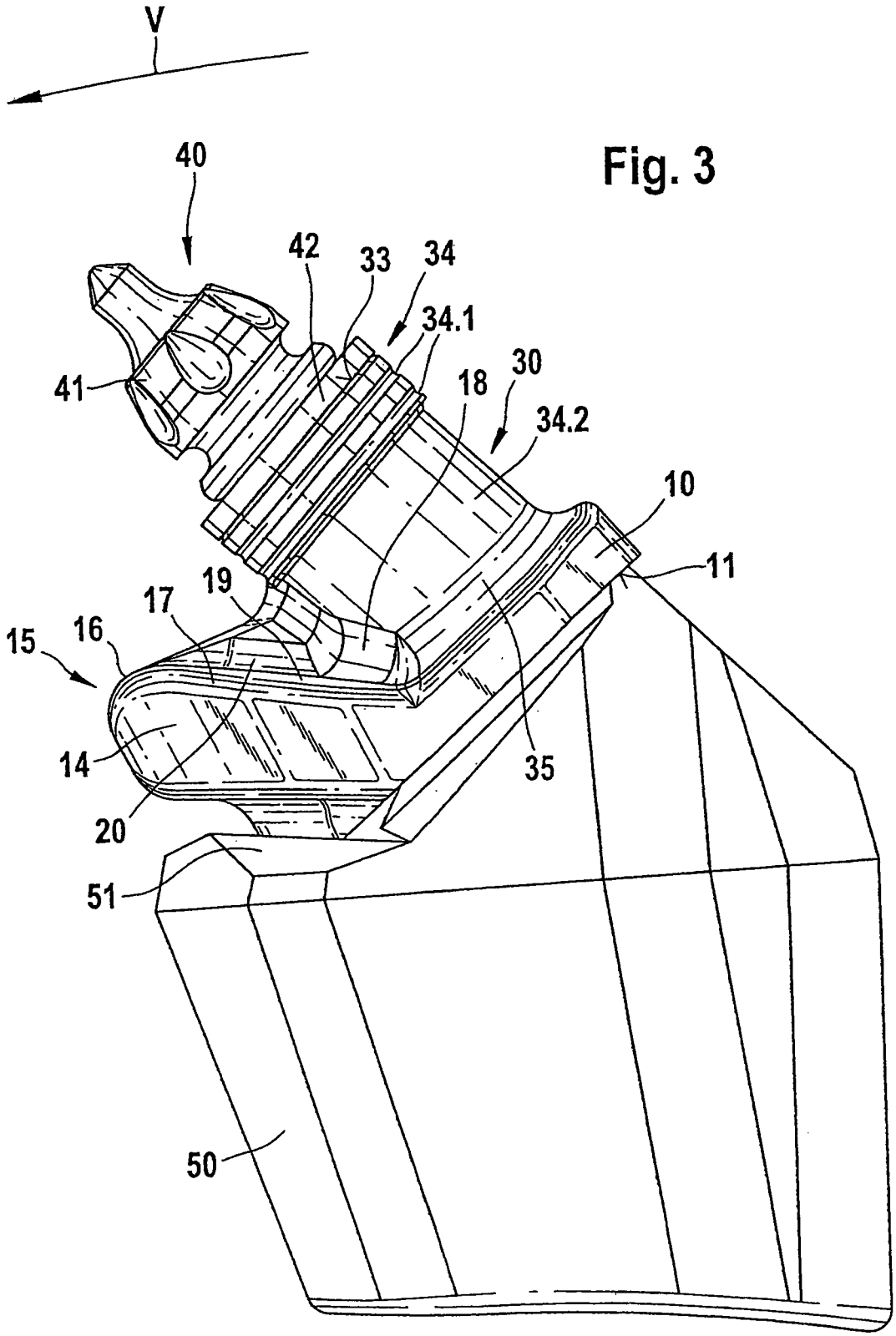
FIG. 3 is a lateral view of a tool combination with the chisel holder represented in FIG. 1 and FIG. 2, as well as a base body and a round shank chisel mounted in the chisel holder.

As FIG. 3 shows, a shank section of a round shank chisel 40 can be inserted into the chisel receiver 31. Following the shank section, the round shaft chisel has a chisel head 41 with a chisel tip made of a hard alloy. With the interposition of a wear-protection disk 42, the chisel head 41 is supported on the support face 33 of the holding neck 30.

As FIG. 2 shows, the holding neck 30 forms a center connecting element 34.2 between the cylindrical end section 34 and the rounded section 35. The connecting element is connected in one piece to the protrusion 15 by a connecting section 20.

Here, the connecting section 20 extends in the tool advancement direction, starting at the connecting element 34.1. It has a flattened strip segment 21, which makes a transition via inclined chip faces 22 into the lateral faces 19 of the protrusion 15. The connecting section 20 runs continuously in the direction of a front end area of the protrusion 15.

Two inclined faces 14, which laterally delimit the protrusion 15, also terminate in this area, so that an arrow-shaped contour results together with the connecting section 20 and the inclined faces 14.

The protrusion 15 is closed off in the end area by a rounded transition area 16. The inclined faces 14 follow the lateral faces 19 via rounding transitions 17. For reasons of clamping optimization, on the one hand, and for improved chip removal on the other, the connecting section 20 is connected to the holding neck 30 by rounded transition sections 18, 23.

German Patent Reference 10 2004 057302.6-24, the priority document corresponding to this invention, and its teachings are incorporated, by reference, into this specification.

What is claimed is:

1. A chisel holder for a road milling machine, having a base element (10) which supports a holding neck (30), wherein the holding neck (30) has a chisel receiver (31), and a protrusion (15) is connected to the base element (10) upstream of the holding neck (30) when viewed in an advancing direction of the tool, the chisel holder comprising:

the base element (10) having a connecting section (20) as a chip breaker formed on the base element (10), the connecting section (20), starting at the holding neck (30) and extending at least partially over the protrusion (15), the connecting section (20) forming a strip section (21) and having inclined chip faces (22) on both sides of the strip section (21) which, starting at the strip section (21), diverge toward the base element (10), and the strip section (21) connecting to the holding neck (30) by a rounded transition section (18, 23).

2. The chisel holder in accordance with claim 1, wherein the connecting section (20) extends in the tool advancing direction.

3. The chisel holder in accordance with claim 2, wherein the holding neck (30) has an end section (34) protruding beyond the base element (10), and a width of the strip section (21) extending transversely with respect to the advancing direction is less than a dimension of the end section (34) in the advancing direction.

4. The chisel holder in accordance with claim 3, wherein the end section (34) of the holding neck (30) has the chisel receiver (31) formed as a bore, the end section (34) has a support surface (33) annularly encircling a center longitudinal axis of the chisel receiver (31), the support surface (33) extends radially outward as far as dimensional limits of a cylindrical area of the end section (34), and the connecting section (20) is connected to the holding neck (30) and set back in an axial direction with respect to the support surface (33).

5. The chisel holder in accordance with claim 4, wherein the base element (10) is laterally limited by two inclined faces (14) near the protrusion (15) and are arranged in an arrow shape with respect to each other in the tool advancement direction, and the connecting section (20) and the inclined faces (14) terminate in a frontal end section of the protrusion (15).

6. The chisel holder in accordance with claim 5, wherein the connecting section (20) is hardened.

7. The chisel holder in accordance with claim 6, wherein at least a mechanically resistant element is applied to the connecting section (20).

8. The chisel holder in accordance with claim 7, wherein the connecting section (20) has a conical cutter shape.

9. The chisel holder in accordance with claim 1 , wherein the holding neck (30) has an end section (34) protruding beyond the base element (10), and a width of the strip section (21) extending transversely with respect to the advancing direction is less than a dimension of the end section (34) in the advancing direction.

10. The chisel holder in accordance with claim 1, wherein an end section (34) of the holding neck (30) has the chisel receiver (31) formed as a bore, the end section (34) has a support surface (33) annularly encircling a center longitudinal axis of the chisel receiver (31), the support surface (33) extends radially outward as far as dimensional limits of a cylindrical area of the end section (34), and the connecting section (20) is connected to the holding neck (30) and set back in an axial direction with respect to the support surface (33).

11. The chisel holder in accordance with claim 1, wherein the base element (10) is laterally limited by two inclined faces (14) near the protrusion (15) and are arranged in an arrow shape with respect to each other in the tool advancement direction, and the connecting section (20) and the inclined faces (14) terminate in a frontal end section of the protrusion (15).

12. The chisel holder in accordance with claim 1, wherein the connecting section (20) is hardened.

13. The chisel holder in accordance with claim 1, wherein at least a mechanically resistant element is applied to the connecting section (20).

14. The chisel holder in accordance with claim 1, wherein the connecting section (20) has a conical cutter shape.

15. A chisel holder for a road milling machine, having a base element (10) which supports a holding neck (30), wherein the holding neck (30) has a chisel receiver (31), and a protrusion (15) is connected to the base element (10) upstream of the holding neck (30) when viewed in an advancing direction of the tool, the chisel holder comprising:

the base element (10) having a connecting section (20) as a chip breaker formed on the base element (10), the connecting section (20) starting at the holding neck (30) and extending at least partially over the protrusion (15);

the connecting section (20) forming a strip section (21), and having inclined chip faces (22) on both sides of the strip section (21) which, starting at the strip section (21), diverge toward the base element (10);

the connecting section (20) connected to the holding neck (30) by a plurality of rounded transition sections, at least one of the rounded transition sections (18) disposed on each side of the strip section (21), and the strip section (21) connecting to the holding neck (30) by an other of the rounded transition sections (23).

16. A chisel bolder for insertion into a plug-in receiver of a base body (50) of a road milling machine, the chisel holder comprising:

a base element (10) including a support surface (11) and a protrusion (15) arranged at an angle with respect to the support surface (11), wherein the base body (50) supports the support surface (11) and the protrusion (15) covers a shoulder portion (51) of the base body (50);

a plug-in neck (12) extending from the base element (10) and adapted for insertion into the base body plug-in receiver;

a holding neck (30) formed on the base element (10) on a side opposite the plug-in neck (12), the holding neck (30) including a chisel receiver (31);

a connecting section (20) as a chip breaker formed on the base element (10), the connecting section (20) starting at the holding neck (30) and extending at least partially over the protrusion (15), the connecting section (20) forming a strip section (21), and having inclined chip faces (22) on both sides of the strip section (21) which, starting at the strip section (21), diverge toward the base element (10), the connecting section (20) connected to the holding neck (30) by a plurality of rounded transition sections, at least one of the rounded transition sections (18) disposed on each side of the strip section (21), and strip section (21) connecting to the holding neck (30) by an other of the rounded transition sections (23);

wherein the protrusion (15) is delimited by inclined faces (14) that together with the connecting section (20) results in an arrow shaped contour upstream of the holding neck (30) when viewed in an advancing direction of the base body, and the protrusion (15) includes a rounded transition (16) extending from an end of the strip section (21) toward an upstream end of the protrusion (15).

* * * * *